US007370562B2

(12) United States Patent
Adachi et al.

(10) Patent No.: US 7,370,562 B2
(45) Date of Patent: May 13, 2008

(54) METHOD FOR CONTROLLING SLITTER-SCORER APPARATUS

(75) Inventors: Nokihisa Adachi, Kasugai (JP); Minoru Naitou, Kasugai (JP); Tadao Kamimura, Kasugai (JP)

(73) Assignee: Kabushiki Kaisha Isowa, Aichi (JP)

( * ) Notice: Subject to any disclaimer, the term of this patent is extended or adjusted under 35 U.S.C. 154(b) by 0 days.

(21) Appl. No.: 10/773,589

(22) Filed: Feb. 6, 2004

(65) Prior Publication Data

US 2004/0159693 A1 Aug. 19, 2004

(30) Foreign Application Priority Data

Feb. 13, 2003 (JP) ..... 2003-035520

(51) Int. Cl.
*B26D 3/08* (2006.01)

(52) U.S. Cl. ..... 83/13; 83/504; 83/507; 83/508.2; 83/880; 225/3

(58) Field of Classification Search ..... 83/13, 83/51, 880, 885, 499, 507, 563, 504, 500, 83/508.2; 225/3; 493/56, 60, 64, 65
See application file for complete search history.

(56) References Cited

U.S. PATENT DOCUMENTS

| | | | | |
|---|---|---|---|---|
| 3,540,340 | A * | 11/1970 | Veli | 83/499 |
| 3,886,833 | A * | 6/1975 | Gunn et al. | 83/499 |
| 3,961,547 | A * | 6/1976 | Shainberg et al. | 83/864 |
| 4,506,577 | A * | 3/1985 | Shinomiya et al. | 83/499 |
| 4,627,214 | A * | 12/1986 | Anderson et al. | 53/71 |
| 4,684,360 | A * | 8/1987 | Tokuno et al. | 493/367 |
| 5,125,301 | A * | 6/1992 | Miller et al. | 83/13 |
| 5,325,754 | A * | 7/1994 | Pohl | 83/488 |
| 5,761,980 | A | 6/1998 | Ima et al. | |
| 5,857,395 | A | 1/1999 | Böhm et al. | |
| 2001/0002560 | A1* | 6/2001 | Aoki | 83/13 |

FOREIGN PATENT DOCUMENTS

| | | | |
|---|---|---|---|
| JP | 8-11245 | A | 1/1996 |
| JP | 10-000704 | A | 1/1998 |
| JP | 2002-036399 | A | 2/2002 |
| JP | 2002-331601 | A | 11/2002 |

OTHER PUBLICATIONS

Search Report in corresponding European Patent Application No. 04 00 3153, dated Apr. 15, 2005.
Official Action in Japanese Patent Application No. 2003-035520, dated Mar. 25, 2005.

* cited by examiner

*Primary Examiner*—Kenneth E. Peterson
*Assistant Examiner*—Phong Nguyen
(74) *Attorney, Agent, or Firm*—Stroock & Stroock & Lavan LLP

(57) ABSTRACT

A method for controlling a slitter-scorer apparatus in which a feed line for a paperboard sheet does not need to be stopped when order specification of cutting or scoring for the paperboard sheet has been changed, thereby reducing a setup time, is proposed. The method for controlling a slitter-scorer apparatus including steps of supplying a paperboard sheet along a feed line, and moving a slitter or a scorer in a vertical and/or a widthwise direction to a operative level where the surface of said paperboard sheet is processed thereby wherein: movement of said slitter and/or scorer is controlled such that said slitter and/or scorer either come into sliding contact with or is apart slightly from said surface of the paperboard sheet.

6 Claims, 16 Drawing Sheets

METHOD FOR CONTROLLING SLITTER-SCORER APPARATUS

FIELD OF THE INVENTION

This invention generally relates to a method for controlling slitter-scorer apparatus, more particularly to such a method that can prevent meandering of a paperboard sheet, thereby increasing available yield percentage of the paperboard product and decreasing setup time for production.

DESCRIPTION OF RELATED ART

In a typical process for manufacturing a corrugated fibreboard container box, a continuous corrugated fibreboard or paperboard sheet web such as a single surface paperboard, a double surface paperboard, or a composite double surface paperboard etc. is fed along a feed line, then cut along a direction in which the sheet is fed, in some cases being scored as well, and thereafter assembled into a corrugated fibreboard container.

A slitter-scorer apparatus comprises a plurality of slitters which slit or cut a paperboard in the sheet feeding direction at desired widthwise positions, and a plurality of scorers which score the paperboard in a machine direction at desired widthwise positions.

Each of the slitter apparatuses comprises an opposed slitter blade and anvil with a paperboard sheet disposed therebetween, a rotational drive device which drives the slitter blade rotationally, a horizontal transfer means which transfers the slitter blade and the anvil in a widthwise direction which is perpendicular to the sheet feeding direction, and a vertical transfer means which transfers the slitter blade and the anvil in a vertical direction.

The scorer apparatus which scores the paperboard in a machine direction at a desired widthwise position has a structure very similar to that of the slitter apparatus which slits or cuts a paperboard in a machine direction at a desired widthwise position, and therefore it will not be described in detail.

In accordance with the above mentioned construction of the slitter apparatus, a paperboard fed along a feed path will be slit or cut in a machine direction when the slitter blade and/or the anvil has been transferred vertically upwardly or downwardly from its retracted level to its operative level.

When the order specification for the paperboard has been changed such that the position of the slit must be changed from a first widthwise position to a second widthwise position, the slitter blade will be transferred vertically upwardly (assuming that the slitter is located upside of the paperboard) from its operative level to its retracted level by vertical transfer means thereof. Next, the slitter blade will be transferred in a horizontal direction from the first widthwise position to the second widthwise position while the slitter blade remains in its retracted level. Thereafter, the slitter blade will be lowered from its retracted level to its operative level by the vertical transfer means thereof while the slitter blade remains in the second widthwise position. Therefore, the position of the cut or slit can be changed from the first widthwise position to the second widthwise position by moving the slitter blade along a path generally forming a U-shaped line which has its peak apart from the surface of the paperboard sheet, without interrupting a feed line for the paperboard.

However, a slitter-scorer apparatus of the prior art suffers from the drawback that accurate positioning of the slitter and/or scorer in a vertical direction is difficult to achieve upon the order specification change.

On the one hand, if the slitter-scorer has been in the operative level when the order specification for the paperboard is changed, its successive processes will be: (1) to continue working at the current widthwise position, (2) to start working at a different widthwise position, (3) to stop working. On the other hand, if the slitter-scorer has been in its retracted level when the order specification is changed, its successive processes will be: (1) to continue stopping at the current widthwise position, (2) to start working at the current widthwise position, (3) to start working at a different widthwise position.

When successive processes require the slitter-scorer to start working, the following problems arise:

The first problem is relates to the required setup time for the slitter-scorer. More particularly, upon the paperboard order change, the slitter and/or scorer is transferred vertically by using an air piston/cylinder which merely can control its piston's position point-to-point, that is between an extended position and contracted position apart from each other by the distance of the piston's stroke, so that accurate positioning of the slitter and/or scorer in close proximity to the surface of the paperboard is difficult to achieve. Therefore, the slitter and/or scorer can only be controlled between an operative level and a retracted level which is about 10 mm from the surface of the paperboard, while the slitter and/or scorer remains in a desired widthwise position.

Accordingly, a relatively long setup time is needed in order to move the slitter and/or scorer from the first widthwise position to the second widthwise position along a long path which is far apart from the surface of the paperboard upon a change of the order specification for the paperboard.

Japanese Patent Laid-open Publication H8-11245 discloses an apparatus which maintains the slitter and/or scorer in the operative level during its movement from the first widthwise position to the second widthwise position. This apparatus, although it produces waste paperboard until the setup has been completed, may cause meandering of a paperboard sheet, thereby potentially having an adverse effect which leads to an interruption of processing. For this reason, the transfer speed of the slitter in this apparatus must be kept low in accordance with the feed speed of the paperboard sheet in order to avoid meandering thereof.

The second problem is related to the reduction of available yield percentage of the paperboard product. The longer the setup time takes, the lower the available yield percentage, since paperboard sheet supplied during the setup time will be scrapped. In addition, in the typical slitter-scorer apparatus of the prior art which transfers the slitter and/or scorer vertically from its retracted level to its operative level just before the processing, unnecessary paperboard is supplied during movement of the slitter and/or scorer to the operative level in response to the operation start command has been received, resulting in a further reduction in the available yield percentage of the paperboard product. As such, it is desired to maintain the slitter and/or scorer at a standby position where the slitter and/or scorer is ready for receiving the operation start command.

Especially, it is important to improve the available yield percentage of the paperboard product, since the feed speed of paperboard has been increased in today's paperboard processing machines.

The third problem is that there are difficulties in dealing with fluctuations in the condition of processing in response to the order change and with disturbance of the slitter-scorer apparatus itself or quality of the paperboard.

More particularly, the fluctuations in the condition of processing in response to the order change include change of the scoring pressure, and the disturbance of the slitter-scorer apparatus includes depth of wear of the slitter blade and deflection of the shaft which supports the slitter blade, and disturbance of the quality of the paperboard includes fluctuations of moisture content and quality of the paper.

It is desired to control the operative level for the slitter and/or scorer precisely in response to these fluctuations.

SUMMARY OF THE INVENTION

One object of the present invention is to provide a method for controlling a slitter-scorer apparatus in which a feed line for a paperboard sheet does not need to be stopped when an order specification for cutting or scoring for the paperboard sheet has been changed, thereby reducing a setup time for production.

Another object of the present invention is to provide a method for controlling a slitter-scorer apparatus in which a feed line for a paperboard sheet does not need to be stopped when an order specification for cutting or scoring for the paperboard sheet has been changed, and which can prevent meandering of a paperboard sheet, thereby increasing available yield percentage of the paperboard product.

Still another object of the present invention is to provide a method for controlling a slitter-scorer apparatus which can control the operative level for the slitter and/or scorer precisely in response to the change of the order specification for cutting or scoring the paperboard sheet.

One method for controlling a slitter-scorer apparatus according to the present invention includes the steps of supplying a paperboard sheet along a feed line, and moving a slitter or a scorer in a vertical and/or a widthwise direction to an operative level where the surface of said paperboard sheet is processed thereby wherein: movement of said slitter and/or scorer is controlled such that said slitter and/or scorer either comes into sliding contact with or is apart slightly from said surface of the paperboard sheet.

In the method for controlling a slitter-scorer apparatus according to the present invention, it is preferable that the maximum distance between said slitter and/or scorer and said surface of the paperboard does not exceed more than 10 mm when said slitter and/or scorer moves from a first widthwise position of a first operative level to a second widthwise position of a second operative level.

Furthermore, in the method according to the present invention, it is preferable that said slitter and/or scorer be moved simultaneously in said vertical direction and in said widthwise direction so that said slitter and/or scorer moves diagonally toward said second widthwise position when said slitter and/or scorer moves from said first widthwise position of said first operative level to said second widthwise position of said second operative level.

In addition, said diagonal movement of said slitter and/or scorer occurs only when said slitter and/or scorer is positioned in said paperboard sheet.

In addition, a path of movement of said slitter and/or scorer may form a plurality of straight lines which have a generally convex shape which is oriented in such a way that the nearer said straight lines come to its peak, the more said straight lines come apart from said surface of said paperboard sheet.

Furthermore, a path of movement of said slitter and/or scorer may form a curved line which has a generally convex shape which is oriented in such a way that the nearer said straight lines come to its peak, the more said straight lines come apart from said surface of said paperboard sheet.

Preferably, said slitter has an anvil positioned relative to a slitter blade of said slitter such that said paperboard sheet will be clamped therebetween, said operative level being adjusted in accordance with the depth of the wear of said anvil during a setup step of said operative level so that said slitter blade penetrates into said anvil.

Another method for controlling a slitter-scorer apparatus according to the present invention includes the steps of supplying a paperboard sheet along a feed line, and moving a slitter or a scorer in a vertical and/or a widthwise direction between an operative level thereof where said paperboard sheet is processed and a retracted level where jam-up of said paperboard sheet is prevented, further including the step of:

positioning said slitter and/or scorer in a standby position which is more proximal to said surface of said paperboard than said retracted level, while said slitter and/or scorer does not work upon said surface of said paperboard.

According to the method for controlling a slitter-scorer apparatus of the present invention, the surface of the paperboard sheet successively fed along a feed line can be processed by moving a slitter or a scorer in a vertical and/or a widthwise direction to an operative level when an order specification of cutting or scoring for the paperboard sheet has been changed.

Furthermore, the length of the movement path of the slitter and/or scorer to the operative position will be shortened by controlling the movement of said slitter and/or scorer such that said slitter and/or scorer either comes into sliding contact with or is apart slightly from said surface of the paperboard sheet, so that it does not need to stop a feed line for a paperboard sheet, thereby reducing a setup time for production.

According to the method for controlling a slitter-scorer apparatus of the present invention, the time needed for the movement of the slitter and/or scorer to the operative level upon an order change will be shortened by positioning said slitter and/or scorer in a standby position which is more proximal to said surface of said paperboard than said retracted level while said slitter and/or scorer does not work upon said surface of said paperboard, thereby increasing the available yield percentage of the paperboard product, even when the slitter and/or scorer is moved to the operative level after an operation start command has been received.

DESCRIPTION OF PREFERRED EMBODIMENTS OF THE INVENTION

These and other features and advantageous of the invention will be clarified by the following description of the preferred embodiments and reference to the associated drawings. It will be appreciated that although a slitter-scorer apparatus including a plurality of slitters and scorers in series is disclosed, the present invention is applicable to either a slitter apparatus or a scorer apparatus.

Figure 1:
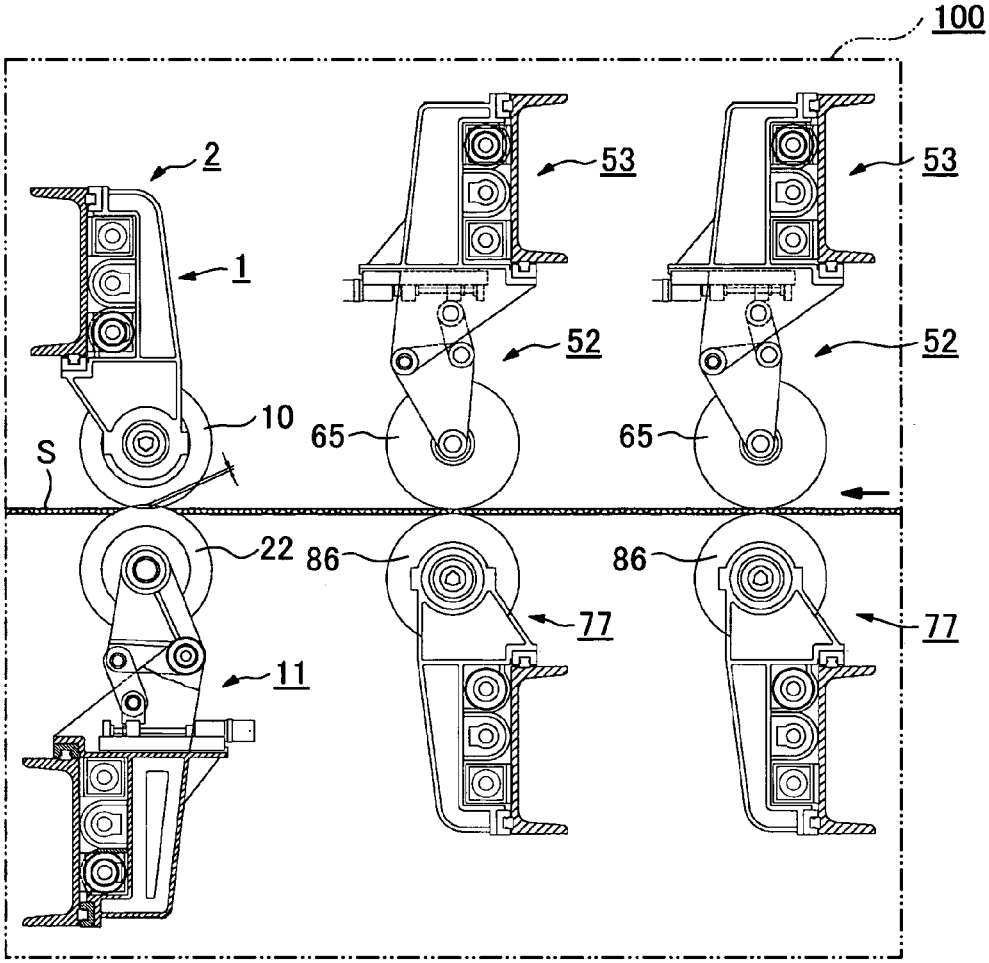
FIG. 1 is a side elevational view showing the slitter-scorer apparatus according to one embodiment of the present invention.
Figure 2:
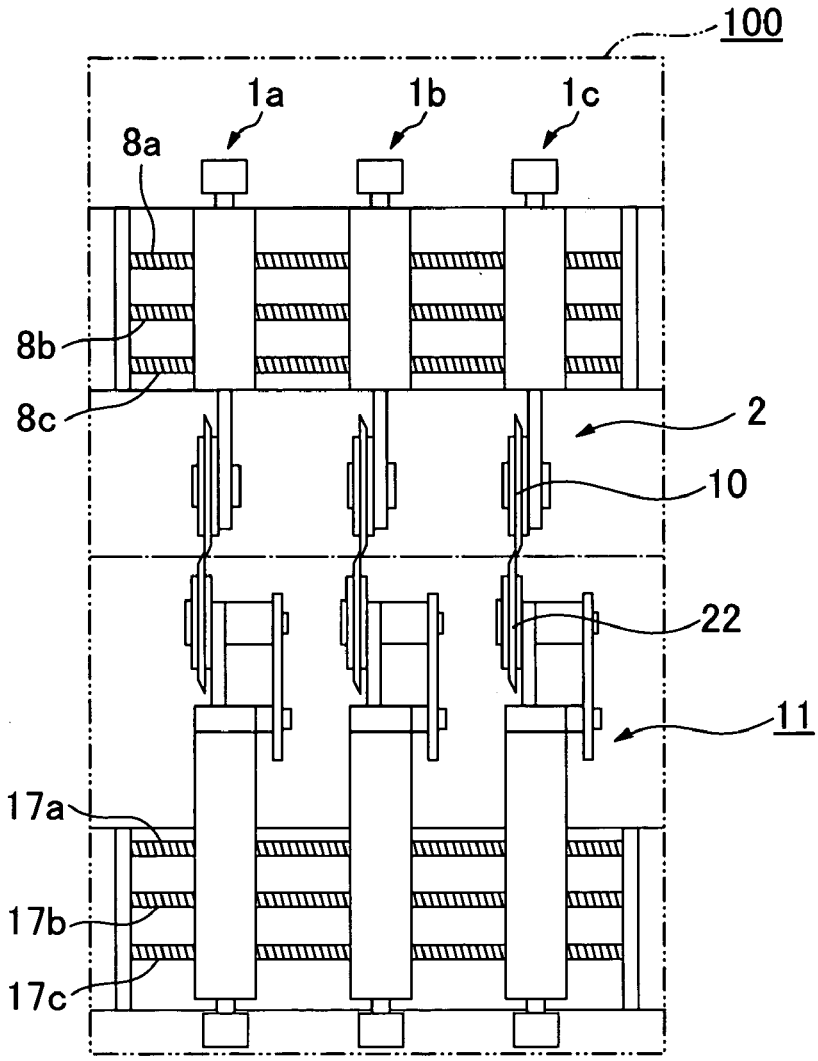
FIG. 2 is a front elevational view showing the slitter-scorer apparatus according to one embodiment of the present invention.

As can be seen in FIG. 1, a slitter-scorer apparatus 100 includes two sets of scorers 52 disposed in the upstream of the feed line of a paperboard sheet S, and one slitter 1 in the downstream thereof. As can be seen in FIG. 2, the slitter 1 comprises three sets of slitters 1*a*, 1*b* and 1*c* spaced apart from each other in a widthwise direction. Similarly, each of the scorers 52 comprises three sets of scorers 52*a*, 52*b* and 52*c* disposed in a widthwise direction. Each of the scorers 52*a*, 52*b* and 52*c* as well as the slitters 1*a*, 1*b* and 1*c* can be moved in a widthwise direction independently so that it can be adjusted in accordance with to the desired width of the paperboard.

Figure 3:
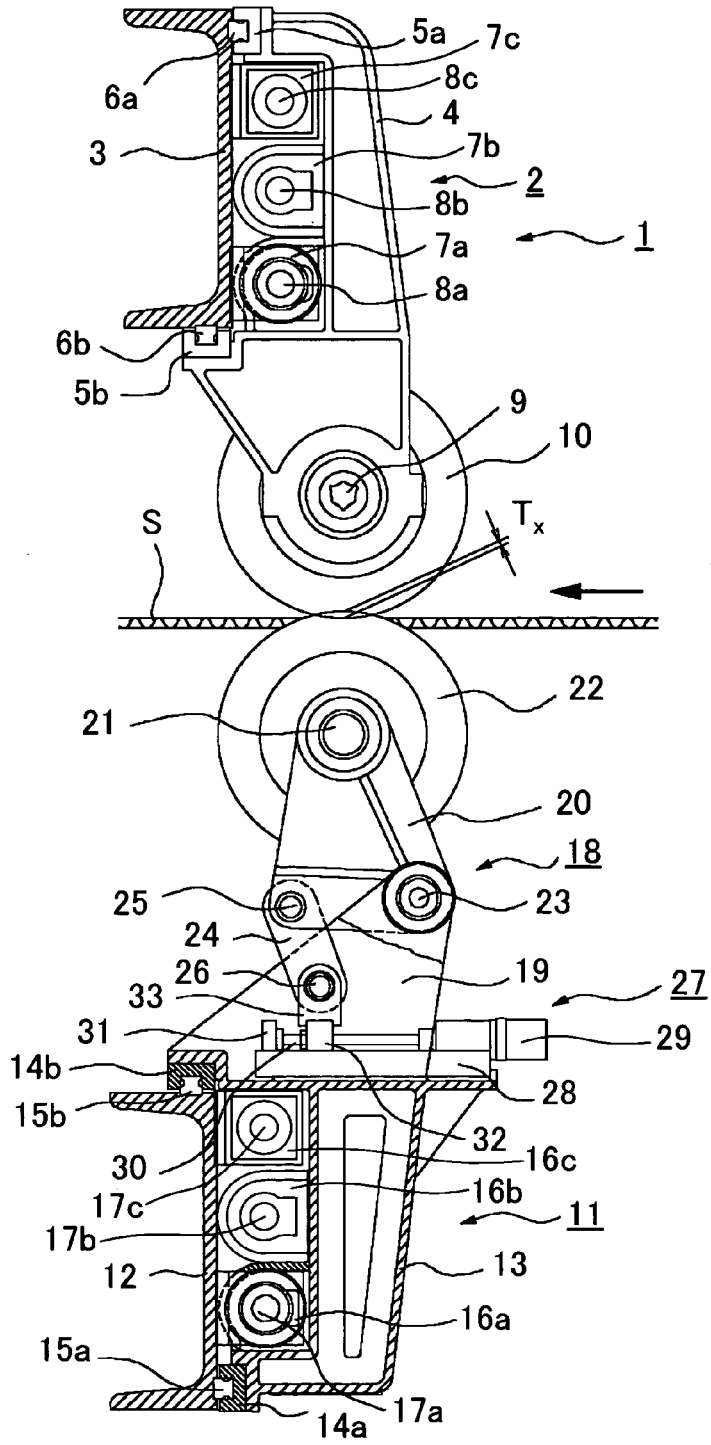
FIG. 3 is a side elevational view showing the slitter of the slitter-scorer apparatus according to one embodiment of the present invention.

As can be seen in FIG. 3, the slitter 1 has an upper slitter 2 and a lower slitter 11 between which paperline PL is disposed. The slitter 1 has a slitter knife or blade 22 disposed on a lower side of the paperline PL, and a slitter receiving member or anvil 10 which receives said slitter knife or blade 22 and is disposed on an upper side of the paperline PL, the slitter consists of a single blade. It is contemplated, however, that the slitter may have a double blade which has an upper blade and a lower blade, or a single blade which has an upper blade and a lower receiving member or anvil.

Figure 4:
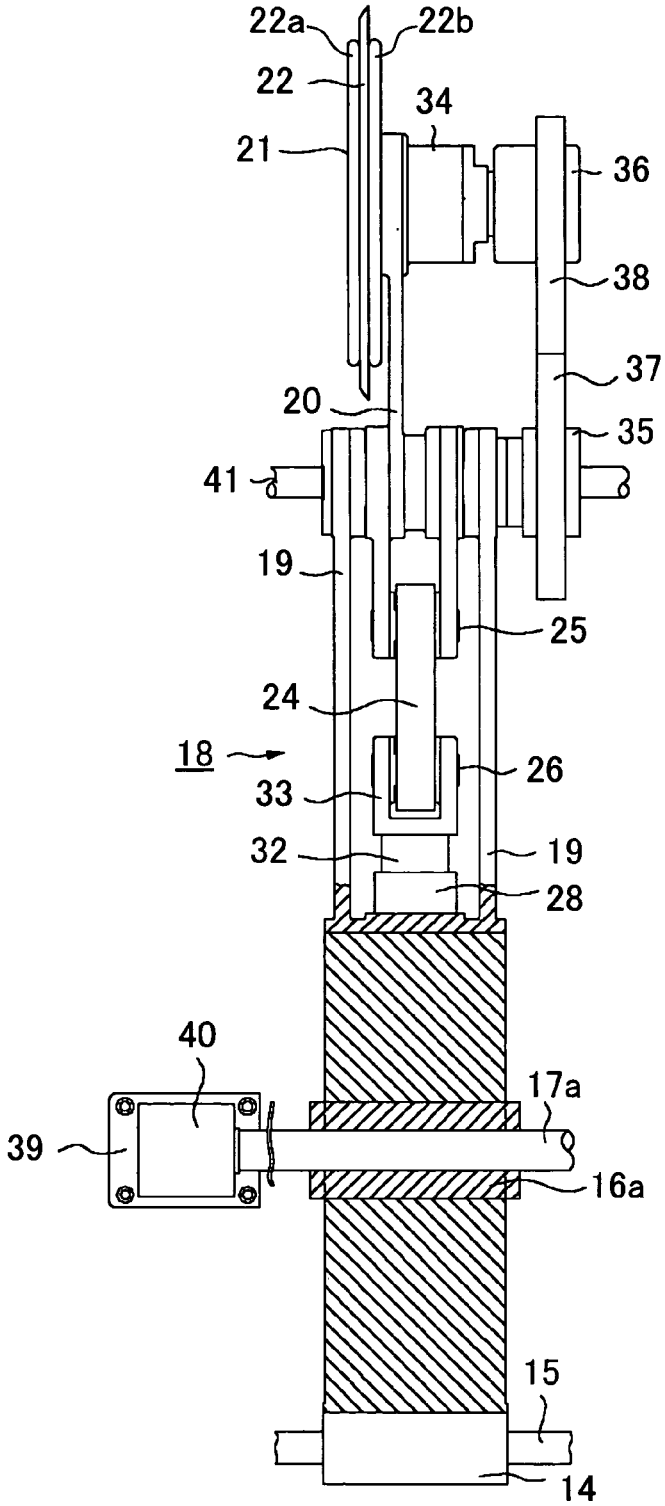
FIG. 4 is a front elevational view showing the slitter of the slitter-scorer apparatus according to one embodiment of the present invention.

As can be seen in FIGS. 3 and 4, the lower slitter 11 has a lower slitter frame 13 mounted on a pair of guide rails 15*a* and 15*b* of the stay 12 via support members 14*a* and 14*b*, respectively, and stay 12 is fixed on a frame (not shown) of the apparatus. The lower slitter 11 mounted on the lower slitter frame 13 is movable and positionable in a widthwise direction in order to be adaptable for a desired production order specification by using a moving mechanism consisting of a bearing member 16*a* and a threaded shaft 17*a* engaging therein. More particularly, as can be seen in FIG. 4, the moving mechanism for positioning the lower slitter 11 at a desired widthwise position includes the threaded shaft 17*a* which can be rotated via a driving device 40 fixedly mounted on a frame of the apparatus (not shown) by a bracket 39, so that the threaded shaft 17*a* engages with the bearing member 16*a* disposed on the lower slitter frame 13 of the lower slitter 11, whereby the threaded shaft 17*a* is rotationally driven by the driving device 40, so that the lower slitter 11 moves in a widthwise direction along the threaded shaft 17*a* threadedly engaged with the bearing member 16*a*. The driving device may be a servo controlled motor including an AC servo-motor (GYS401DC1-SA, 400W) available from Fuji Electrics Co., Ltd. in Japan.

Threaded shafts 17*b* and 17*c* are also provided for moving each of the slitters 1*b* and 1*c* in a widthwise direction, respectively, so that each of the lower slitters can be moved via bearing members 16*b* and 16*c* threadedly engaged with threaded shafts 17*b* and 17*c*, respectively.

The lower slitter frame 13 has the slitter knife or blade 22 attached thereon, and a vertical movement mechanism which moves the slitter knife or blade 22 to either a loaded level or operative level where paperboard sheet S is cut, or to an unloaded level or retracted level. More particularly, the vertical movement mechanism has a link mechanism 18 including a first arm 19 fixedly mounted on the lower slitter frame 13, a second arm 20 connected to the first arm 19 via a pivot point 23 and having a rotational support portion 21 supporting the slitter knife or blade 22, and link arm 24 pivotally connected between a first pivot point 25 of the second arm 20 and a second pivot point 26 of a rotational driving mechanism 27 discussed in detail below. The rotational driving mechanism 27 includes a driving device 29 comprising a servo motor, a threaded shaft 30 connected to the driving device 29, a sliding member 32 threadly engaged with the threaded shaft 30 to allow sliding movement along a slide rail 28, a threaded shaft support 31 supporting the threaded shaft 30 to allow its rotational movement and disposed to be opposed to the driving device 29, and a connecting member 33 mounted on the sliding member 32 and connected to the connecting arm or link arm 24 via a second pivot point 26. The driving device may be a servo controlled motor including an AC servo-motor (GYS201DC1-SA, 200W) available from Fuji Electrics Co., Ltd. in Japan. Since the driving device is comprised of a servo motor, the position of the slitter knife or blade 22 can be controlled with high resolution (e.g. 0.1 mm) and continuously as well, which is different from the conventional air piston device that can merely control its piston's position point-to-point, that is, between an extended position and contracted position apart from each other by a distance of a piston's stroke.

When the driving device 29 of the rotational driving mechanism 27 is actuated, the threaded shaft 30 is rotated, which causes the sliding member 32 to slide on the slide rail 28, followed by the movement of the connecting member 33 mounted on the sliding member 32 as well as the movement of the connecting arm 24, whereby the first pivot point 25 is pivotally moved in response to the movement of the connecting arm 24, so that the second arm 20 is pivotally moved around the pivot point 23.

Figure 5:
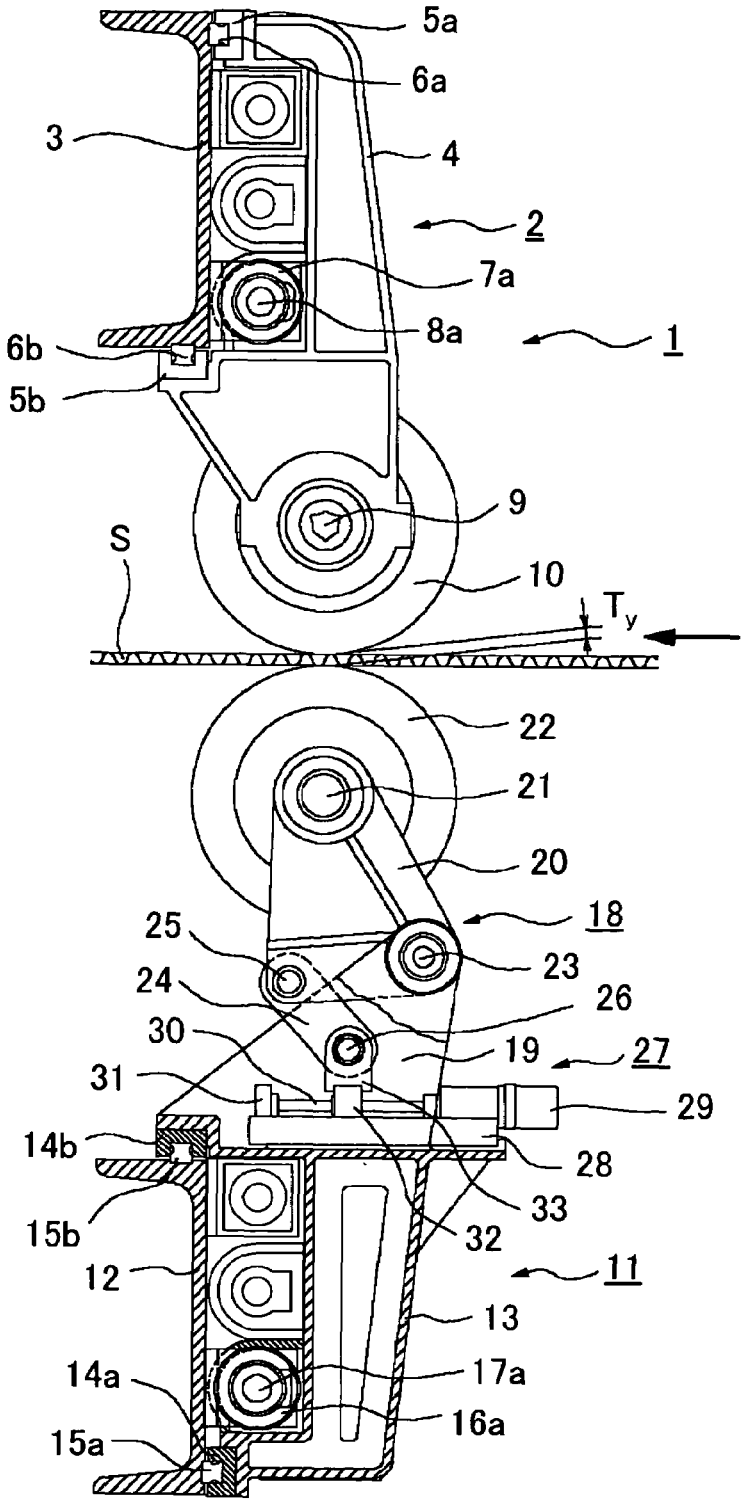
FIG. 5 is a side elevational view similar to FIG. 3, wherein the slitter is positioned between its loaded level and unloaded level.
Figure 6:
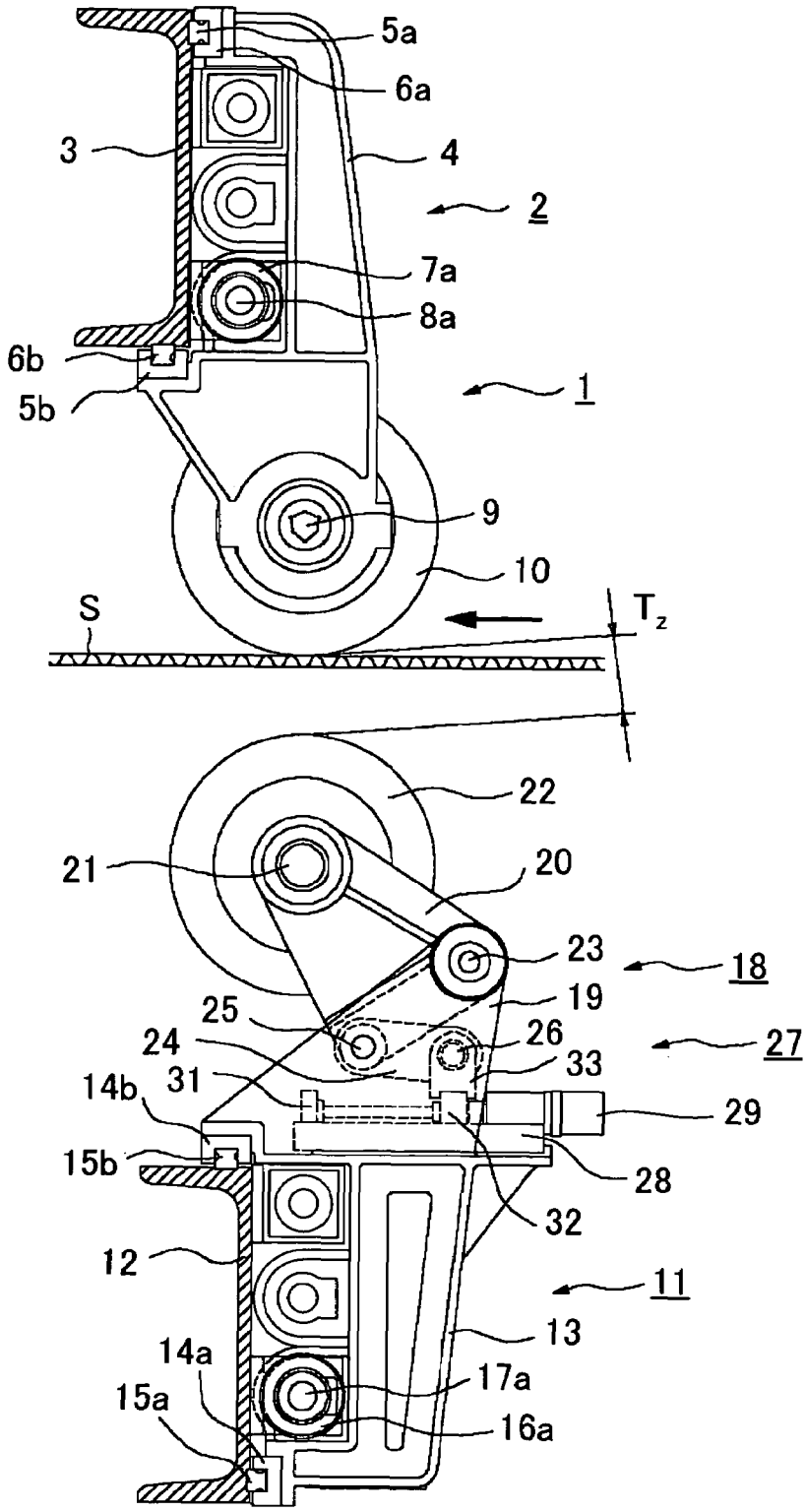
FIG. 6 is a side elevational view similar to FIG. 3, wherein the slitter is in its unloaded level.
Figure 7:
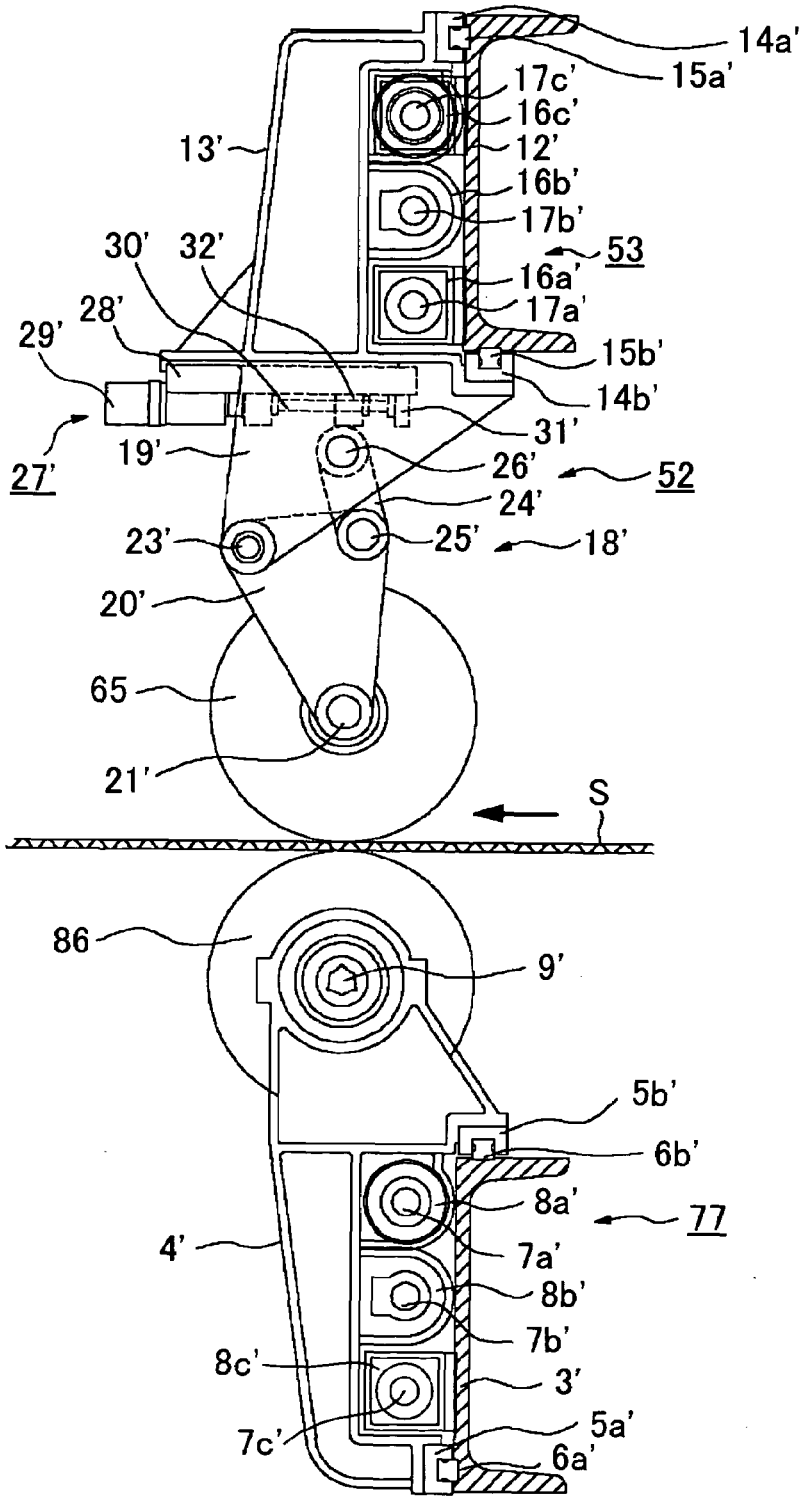
FIG. 7 is a side elevational view showing the scorer of the slitter-scorer apparatus according to one embodiment of the present invention.

More particularly, on the one hand, as can be seen in FIG. 3, a paperboard sheet S will be cut by positioning the slitter knife or blade 22 in the loaded level or operative level thereof where the slitter knife or blade 22 and the slitter knife receiving member or anvil 10 engage each other (Tx), while on the other hand, as can be seen in FIG. 5, the paperboard sheet S will not be cut when there is a gap Ty between the slitter knife or blade 22 and the slitter knife receiving member or anvil 10 by pivotally moving the second arm 20 via the connecting arm 24 when the sliding member 32 is driven in a right hand direction toward the driving device 29 by the driving device 29. As can be seen in FIG. 6, when the slitter knife or blade 22 is positioned in its fully unloaded or retracted level, there will be a gap Tz between the slitter knife or blade 22 and the slitter knife receiving member or anvil 10, which is caused by moving the sliding member 32 in its maximum right hand direction toward the driving device 29.

As such, the slitter knife or blade 22 mounted on the second arm 20 may be positioned between the loaded or operative level and unloaded or retracted level reciprocally relative to the paperline PL of the paperboard sheet S.

As can be seen in FIG. 4, the rotational driving mechanism for the slitter knife or blade 22 includes a slitter knife or blade rotating device (not shown) mounted on a frame of the apparatus (not shown), a driving shaft 41 connected to the slitter knife or blade rotating device and extending in parallel with respect to the threaded shaft 17*a*, a first transmission member 37 fixed on the driving shaft 41 via a first mounting member 35, a second transmission member 38 fixed on the shaft 34 via a second mounting member 36, whereby a rotational driving force is transmitted from the first transmission member 37 to the second transmission member 38. The first arm 19 and the second arm 20 are mounted on the driving shaft 41 via a bearing which allows rotational movement therebetween and comprises a pivot point therebetween. The slitter knife or blade 22 is rotated by the second transmission member 38 which is driven by the first transmission member 37, which is in turn driven by the driving shaft 41. The driving shaft 41 is driven by a slitter knife driving device (not shown). The first mounting member 35 will be moved along the driving shaft 41 when the lower slitter 18 is moved along the threaded shaft 17 in the widthwise direction. The circumferential speed of the slitter knife or blade 22 is slightly faster than the feeding speed of the paperboard sheet, but the former may be more than double the latter according to the condition of production. Although this driving mechanism for the slitter knife or blade 22 is of a conventional type, as long as the slitter knife or blade 22 is rotationally driven, any driving mechanism is suitable; for example, the slitter knife or blade 22 can be rotated by using rotating drive device attached directly on the support portion 21 thereof.

The structure of the upper slitter 2 is similar to the lower slitter 11 except for that the lower slitter 11 including slitter receiving member or anvil which does not move between loaded level and unloaded level, so that its support mechanism and its movement in the widthwise direction described in detail below is similar to that of the upper slitter 2.

As can be seen in FIG. 3, the upper slitter frame 4 is mounted on a pair of guide rails 6*a* and 6*b* via support members 5*a* and 5*b*. The upper slitter 2 mounted on the upper slitter frame 4 is movable and positionable in a widthwise direction in order to be adaptable for a desired production order specification by using a moving mechanism consisting of bearing member 7*a* and threaded shaft 8*a* engaged therein. Threaded shafts 8*b* and 8*c* are provided for moving each of the slitters 1*b* and 1*c* in the widthwise direction, respectively, such that each of the upper slitters can be moved via bearing member 7*b* and 7*c* threadedly engaged with threaded shafts 8*b* and 8*c*, respectively.

The upper slitter frame 4 supports the slitter knife receiving member or anvil 10 which receives the slitter knife or blade 22, to allow the rotating movement of the anvil 10 via a rotational support 9. Since the slitter knife receiving member or anvil 10 is a member which receives the slitter knife or blade 22 when the paperboard sheet S is cut while the paperboard sheet is fed along the paperline, the slitter knife receiving member or anvil 10 is preferably positioned such that it comes into contact the surface of the paperboard sheet S. The slitter knife receiving member or anvil 10 can be a type which is rotated actively by a driving device (not shown), or a type which is rotated passively by the frictional force due to the contact between the circumferential portion of the slitter knife receiving member or anvil 10 and the paperboard sheet S, or by the frictional force due to the contact between the slitter knife or blade 22 and the slitter knife receiving member or anvil 10.

The structure of the scorer is similar to that of the slitter, and those elements of the structure of the score similar to those of the slitter previously disclosed will be designated with the same reference numerals as those designating said similar element of the slitter. The difference between the scorer and the slitter are as follows.

Firstly, the scorer which scores upon the surface of the paperboard sheet is different from the slitter which cuts the paperboard sheet, in that instead of including the slitter knife or blade 22 in the lower slitter and the slitter knife receiving member or anvil 10 in the upper slitter, the lower scorer has a lower scoring roll 86 and the upper scorer has an upper scoring roll 65. Secondly, the slitter has a transfer means disposed on the underside thereof which moves the slitter knife or blade 22 between a loaded or operative level and unloaded or retracted level, while the scorer has a transfer means disposed on the upperside thereof which moves the upper scoring roll 65 between a loaded or operative level for scoring and unloaded or retracted level.

The upper scoring roll 65 is an active scoring roll, while the lower scoring roll 86 is a passive scoring roll. Since the lower scoring roll 86 will receive the upper scoring roll 65, the lower scoring roll 86 is preferably disposed to be a level where the lower surface of the paperline PL of the paperboard sheet S is supported. The scoring rolls do not need any rotating drive mechanism described in relation to the upper slitter. However, if desired, both the upper scorer and the lower scorer can have rotational drive devices, respectively, in which case, paperboard S will be scored from both the upper and lower surfaces.

Figure 8:
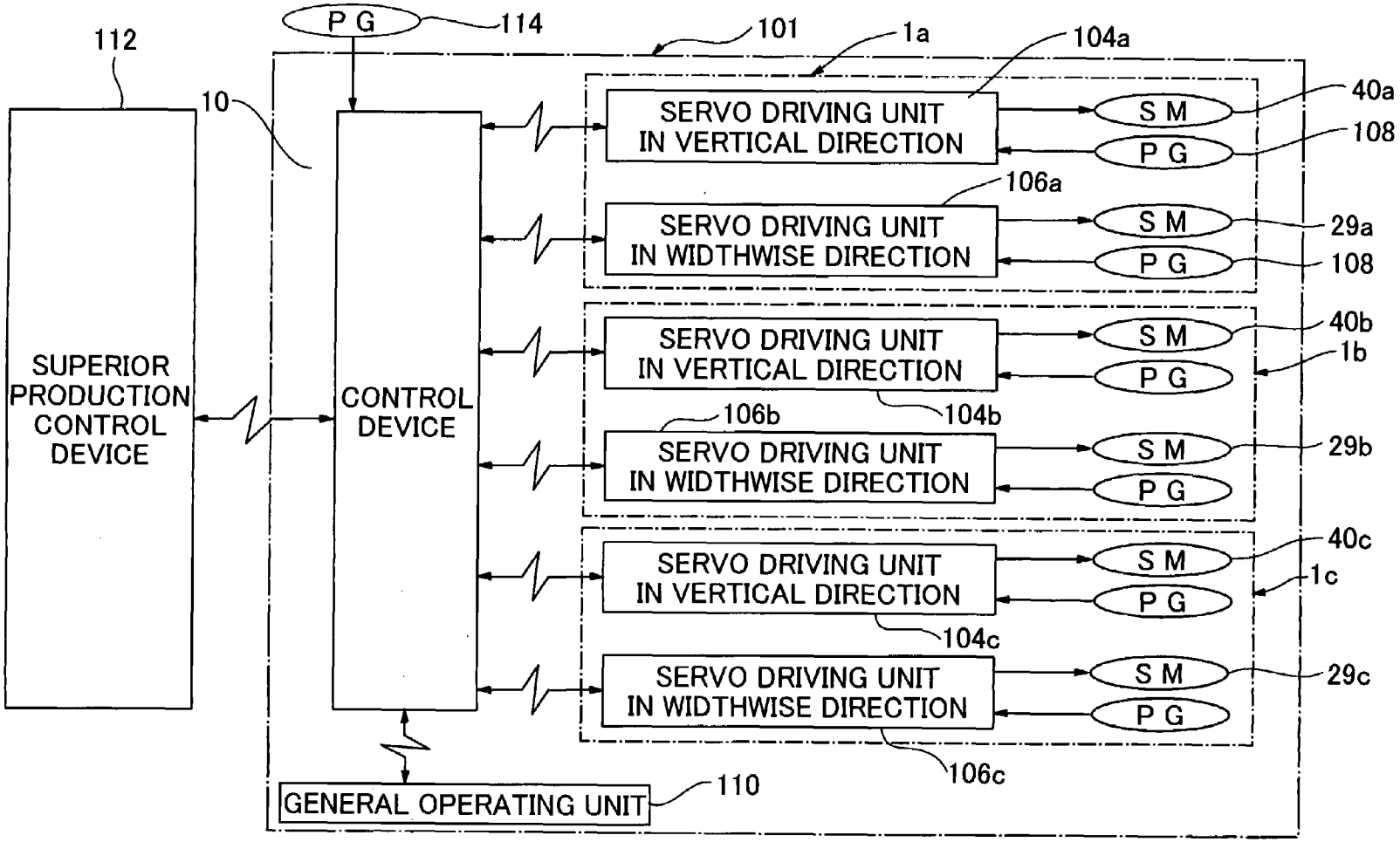
FIG. 8 is a block diagram showing a control circuit for the slitter-scorer apparatus according to one embodiment of the present invention.

Referring now to FIG. 8, a control circuit 101 for the slitter-scorer apparatus 100 includes a control device 102, widthwise direction transfer servo driving units 104*a*, 104*b* and 104*c* via which servo motors 40*a*, 40*b* and 40*c* for the slitter 1*a*, 1*b* and 1*c* are connected, and vertical direction transfer servo driving units 106*a*, 106*b* and 106*c* via which servo motors 29*a*, 29*b* and 29*c* for the slitter 1*a*, 1*b* and 1*c* are connected respectively. A position sensor 108 is attached on each of the respective servo motors 40, 29 and is connected to one of the respective servo driving units. A general operating unit 110 including a keyboard or a touch-panel disposed on an operator panel of the slitter-scorer apparatus 100 and a superior production control device 112 for controlling a corrugator line are connected to the control device 102, a double facer (not shown) and a pulse generator 114 for detecting the actual speed of the paperboard sheet as well. The general operating unit 110 is used for inputting data identifying positions for each of the slitters and scorers corresponding to the desired order specification for the paperboard product, which data will be sent to the control device 102 from the superior production control device 112 in the form of an operation command and feed speed control command for the paperboard. Each of the servo motors for the respective scorers 52*a*, 52*b* and 52*c* is also connected to the control device 102 via a respective servo driving unit.

When the order specification of cutting the paperboard sheet is changed, controlling commands identifying the timing of the order change, the feed speed for the paperboard sheet, and positions for each of the slitters and/or scores are set in accordance with the feed speed data from the superior production control device 112, and these data will be sent to each of the servo driving units 104 and 106 after being processed in the control device 102. As such, each of the slitter knife or blade will be repositioned at a renewed desired location by driving respective servo motors.

The method for controlling the slitter-scorer apparatus described above will now be disclosed in detail. As the method for controlling the scorer is the same as that for controlling the slitter, only method for controlling the slitter will be explained below.

The superior production control device 112 stops operating position data and moving path data for each of the slitters in advance. The operating position data includes widthwise position data and vertical position data which identify the operating or working position in three dimensional space. The moving path data identifies how the slitters should be moved. In the case of a zigzag-like movement path described in detail below, such data includes a distance from the surface of the paperboard sheet during parallel movement of the slitter along the surface of the paperboard, and distance of a diagonal movement during diagonal movement of the slitter relative to the surface of the paperboard.

When the order specification of the paperboard sheet is changed, one of a slitter 1 which will be used in the successive process is selected based upon the operating position data stored in the superior production control device 112. Preferably, the slitter 1 is selected such that it has to be moved only a minimum distance to the desired operating position.

The current position of the slitter 1 is either in the operative level or retracted level. In any case, it is critical for determining the setup time to move the slitter in a widthwise direction from these positions to an other operative level, and thus movement of such a slitter from one position to the other operative level will described in detail with reference to the FIGS. 9 and 10.

Figure 9A:
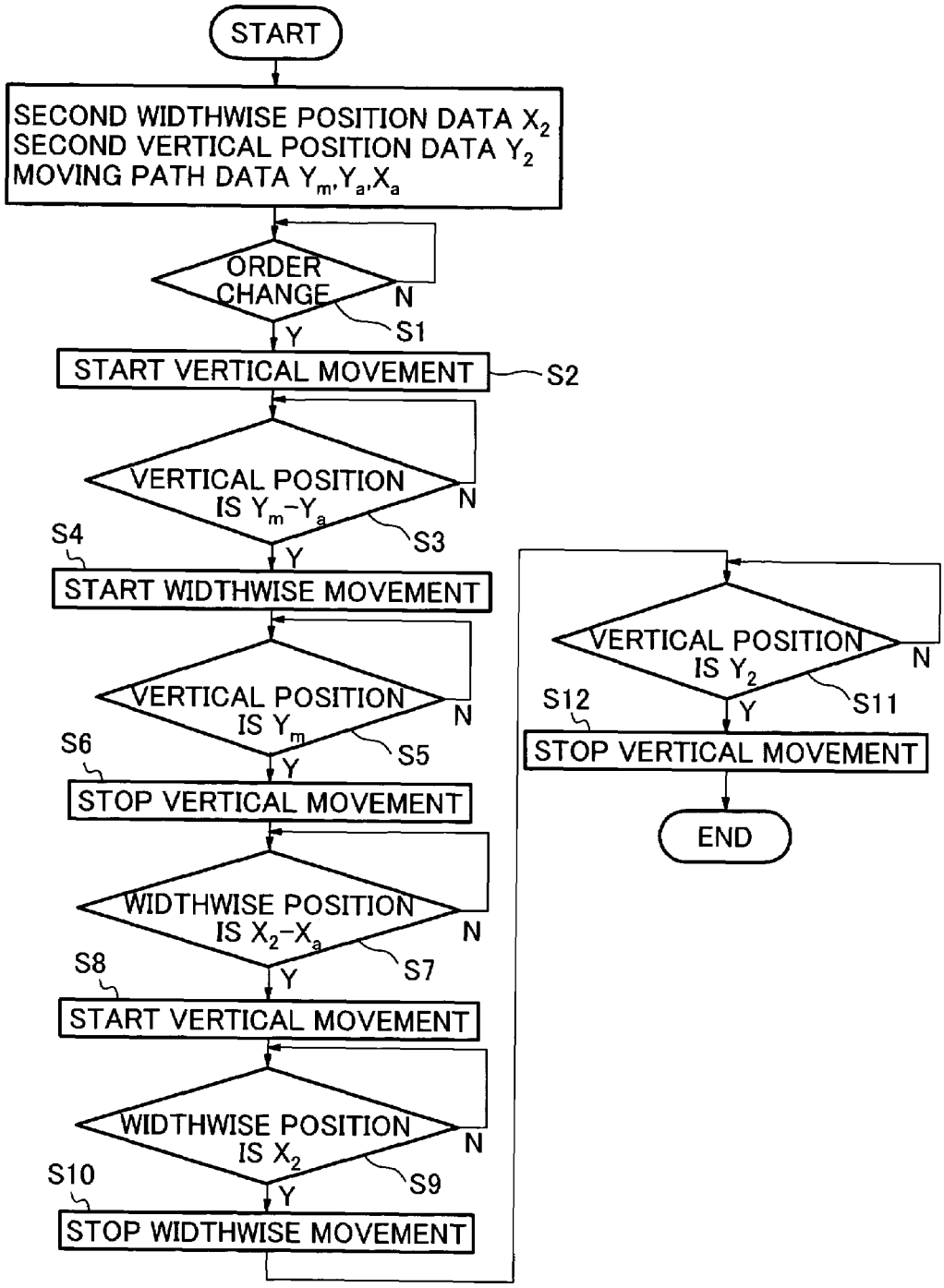
FIG. 9A is a flow chart showing how the slitter-scorer apparatus according to one embodiment of the present invention operates.
Figure 9B:
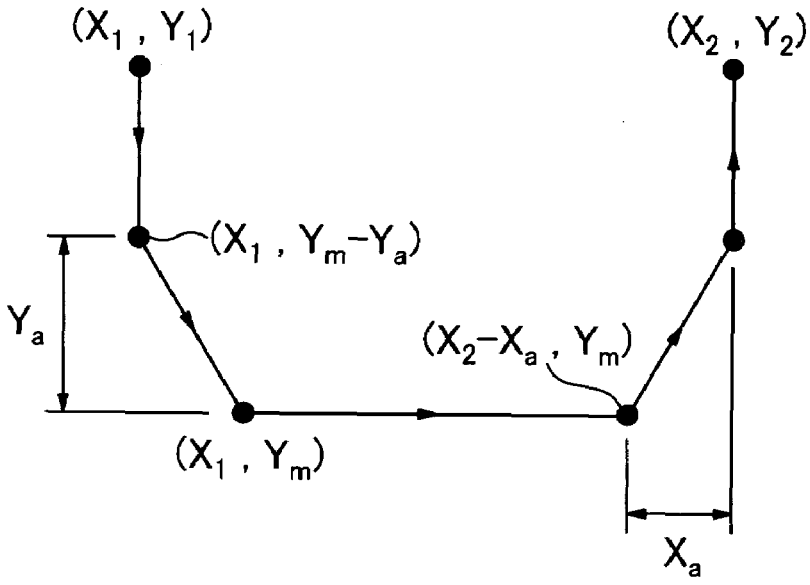
FIG. 9B is a positional diagram showing a movement path of the slitter of the slitter-scorer apparatus according to one embodiment of the present invention.
Figure 10:
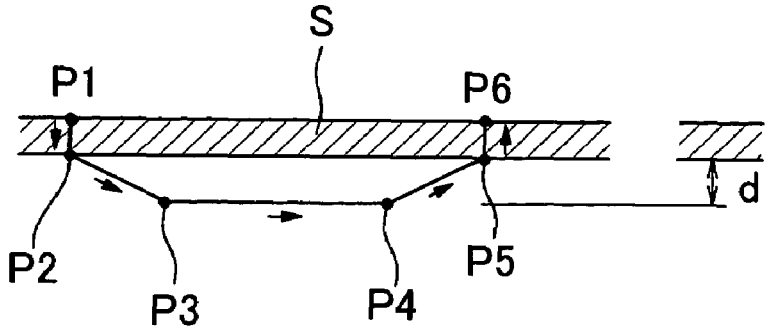
FIG. 10 is a positional diagram showing the movement path of the slitter head and/or scorer head of the slitter-scorer apparatus according to one embodiment of the present invention.

As can be seen in FIG. 9, the operating position data identifying a next order includes a second widthwise position data $X_2$, a second vertical position data $Y_2$, and the moving path data includes a vertical position data $Y_m$ during movement of the slitter parallel to the paperboard surface, a vertical distance data $Y_a$ for a diagonal downward movement of the slitter, and a vertical distance data $X_a$ for a diagonal upward movement of the slitter.

After deciding whether any order change exists (S1), in the case of an order change, vertical movement of the slitter is started (S2) and continued until the vertical position of the slitter reaches $Y_m-Y_a$ (S3). More particularly, one of the servo driving units 104 is selected via the control device 102 based upon the data received from the general operating unit 110, and the selected servo driving unit 104 sends a command to the respective servo motor 29, thereby transferring the slitter knife or blade 22 of the slitter 1 from operative level P1 to P2 which corresponds to the surface of the paperboard shown in FIG. 10. Moving distance of the slitter knife or blade 22 is measured by a counter device at every moment. Since the length of the path of the slitter knife or blade 22 which crosses the paperboard S can be minimized, meandering of the paperboard sheet S will be prevented.

More particularly, when the driving device 29 is activated, the threaded shaft 30 is rotated, the sliding member 32 is slid along the slide rail 28, and the second arm 20 supporting the slitter knife or blade is rotated, whereby the slitter knife or blade is moved to the position P2. The moving distance of the slitter knife or blade 22 with respect to the paperboard sheet S is determined by the sliding distance of the sliding member 32. The position of the slitter knife or blade with respect to the paperboard sheet S is determined according to the position of the sliding member 32 driven by the driving device 27.

Then, the movement of the slitter in the widthwise direction is started (S4) and continued (S5) until the vertical position of the slitter reaches $Y_m$ (S6). More particularly, one of the servo driving units is selected via the control device 102 based upon the data received from the general operating unit 110, and the selected servo driving unit sends a command to the servo motors 29 and 40, thereby transferring the slitter knife or blade 22 of the slitter 1 from position P2 to P3 shown in FIG. 10. The distance "d" between the position P3 and the surface of the paperboard sheet is determined such that the slitter knife or blade comes into sliding contact with or is apart slightly (e.g. less than 10 mm) from the surface of the paperboard sheet S.

After the widthwise position has reached $X_2-X_a$ (S7), vertical movement of the slitter is started (S8). More particularly, one of the servo driving units 106 is selected via the control device 102 based upon the data received from the general operating unit 110, and the selected servo driving unit 106 sends a command to the respective servo motor 40, thereby transferring the slitter from position P3 to P4 along a path generally parallel to the surface of the paperboard S shown in FIG. 10.

After the widthwise position has reached $X_2$ (S9), the movement of the slitter in the widthwise direction is stopped (S10). More particularly, both of the servo driving units 104 and 106 are selected via control device 102 based upon the data received from the general operating unit 110, and the selected servo driving units 104 and 106 send command to the servo motors 29 and 40, thereby moving upwardly diagonally the slitter from position P4 to P5 which corresponds to the level of the surface of the sheet shown in FIG. 10.

After the vertical position has reached $Y_2$ (S11), the movement of the slitter in the vertical direction is stopped (S12). More particularly, one of the servo driving units 104 is selected via the control device 102 based upon the data received from the general operating unit 110, and the selected servo driving unit 104 sends a command to the respective servo motor 29, thereby transferring the slitter knife or blade 22 of the slitter 1 from position P5 to the operative level P6. Since the length of the path of the slitter knife or blade 22 which crosses the paperboard S can be minimized, meandering of the paperboard sheet S will be prevented.

Figure 12:
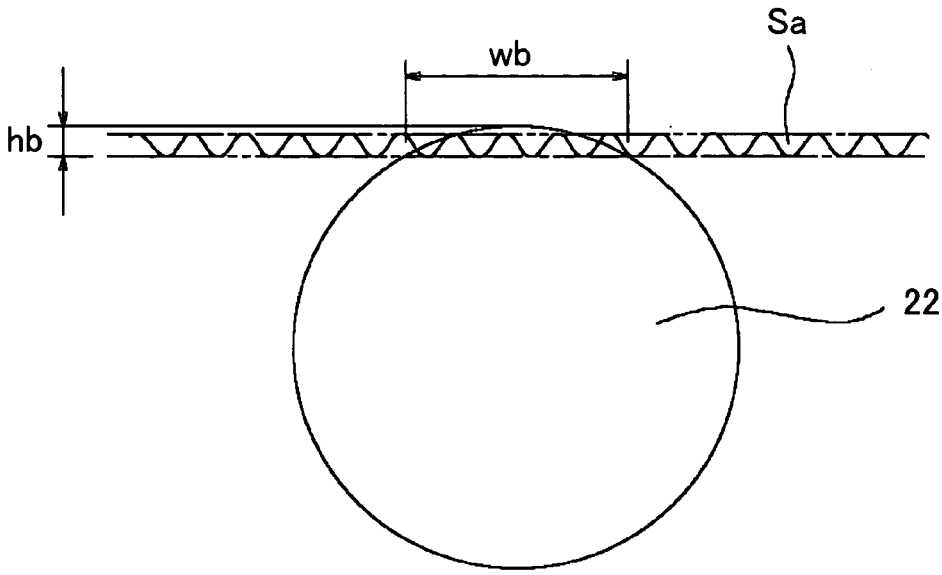
FIG. 12 is a schematic view showing a relationship between the slitter and the paperboard sheet when the slitter cuts a thin paperboard sheet.
Figure 13:
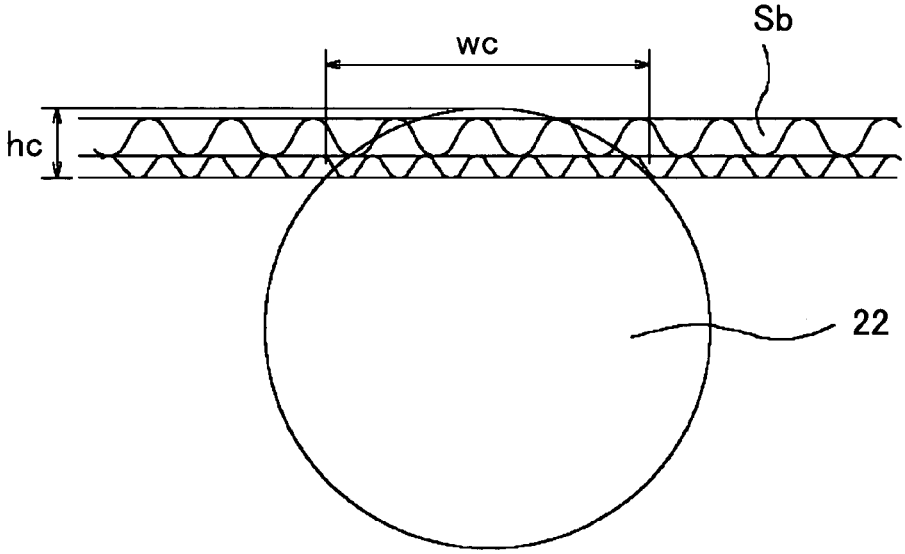
FIG. 13 is a schematic view showing a relationship between the slitter and the paperboard sheet when the slitter cuts a thick paperboard sheet.

As can be seen in FIGS. 12 and 13, since a single layered paperboard sheet Sa has a different penetrating depth and contact surface area with the slitter knife or blade than that of a double layered paperboard sheet Sb, the operative level P6 of the slitter knife or blade can be selected depending upon the penetrating depth hb or hc, as desired.

Also, the operative level for the slitter 1 can be adjusted in accordance with the depth of the wear of the slitter receiving member or anvil, in a case where the slitter knife or blade has a slitter receiving member or anvil disposed opposed thereto, and at the operative level, penetrates into the slitter receiving member or anvil.

In summary, the slitter and/or scorer can be moved from a current operative level to a next operative level in a such way that the slitter and/or scorer either comes into sliding contact with or is apart slightly from the surface of the paperboard sheet, thereby increasing available yield percentage of the paperboard product by reducing a setup time.

Figure 14:
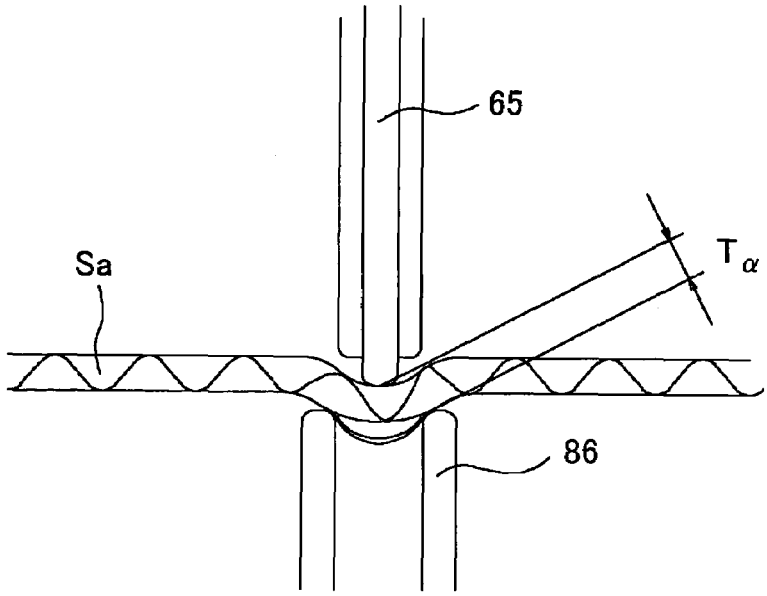
FIG. 14 is a schematic view showing a relationship between the scorer and the paperboard sheet when the scorer scores a thin paperboard sheet.
Figure 15:
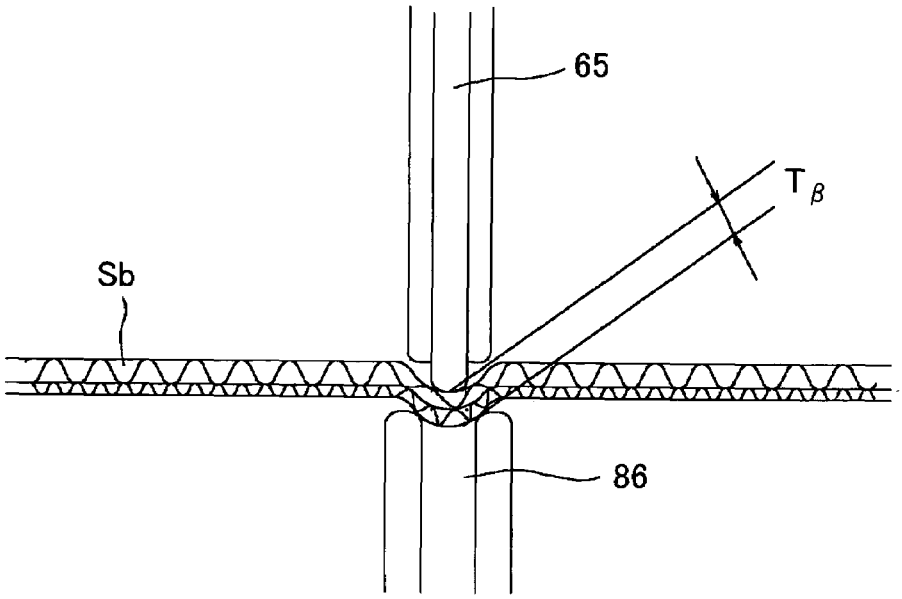
FIG. 15 is a schematic view showing a relationship between the scorer and the paperboard sheet when the scorer scores a thick paperboard sheet.

Note that the method for controlling the scorer is similar to that of the slitter, which includes adjustment of a scoring position. As can be seen in FIGS. 14 and 15, since the scorer of a single layered paperboard sheet Sa has a scoring pressing depth different from that of a double layered paperboard sheet Sb, the operative level P6 of the scorer can be selected depending upon the scoring pressing depth T $\alpha$ or T $\beta$, as desired.

Figure 11:
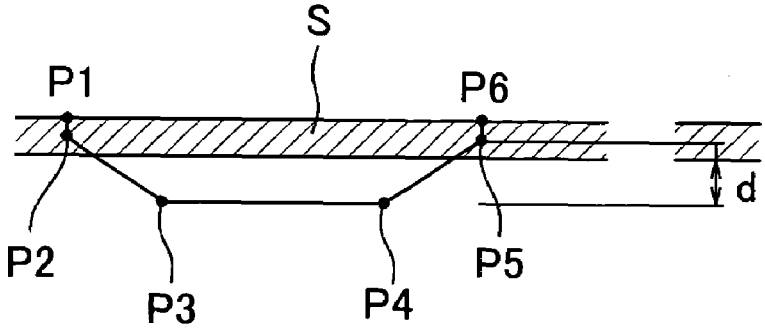
FIG. 11 is another positional diagram showing the movement path of the slitter head and/or scorer head of the slitter-scorer apparatus according to one embodiment of the present invention.

In the case of a thin paperboard sheet S, as shown in FIG. 11, position P2 can be located in the paperboard S, because meandering of the paperboard sheet S is less likely, whereby the slitter knife or blade 22 may start moving before it has been apart from the surface of the paperboard sheet S. In this case, the length of the movement path of the slitter from one operative level to another operative level will be further shortened, without the risk of meandering of the paperboard sheet S, thereby increasing available yield percentage of the paperboard product by further reducing setup time.

Note that any slitter 1 which will not used in the next process can be positioned in a standby position which is closer to the surface than the retracted level thereof. The distance between a slitter in its standby level and the surface of the paperboard sheet may be about 10 mm.

The inventor tried a bench mark test in order to confirm the effect of the above mentioned apparatus.

Assuming that an order specification of scoring for the paperboard sheet has been changed, one scorer unit is moved in both vertical and widthwise directions as shown in FIG. 11, by which a scoring condition on the surface of the paperboard, generated length of the wasted paperboard, and whether meandering of the paperboard sheet has occurred, are respectively determined.

Conditions for the bench mark test are as follows:

(1) Tested sheet: Paperboard sheet of 5 mm in thickness.
(2) Feeding speed: 3000 mm/sec
(3) Moving distance of the scorer:
  In vertical direction: 10 mm
  In widthwise direction: 100 mm
(4) Maximum speed of the scorer:
  In vertical direction: 200 mm/sec
  In widthwise direction: 1000 mm/sec The result of the test is shown in FIGS. 16-18.

Figure 16:
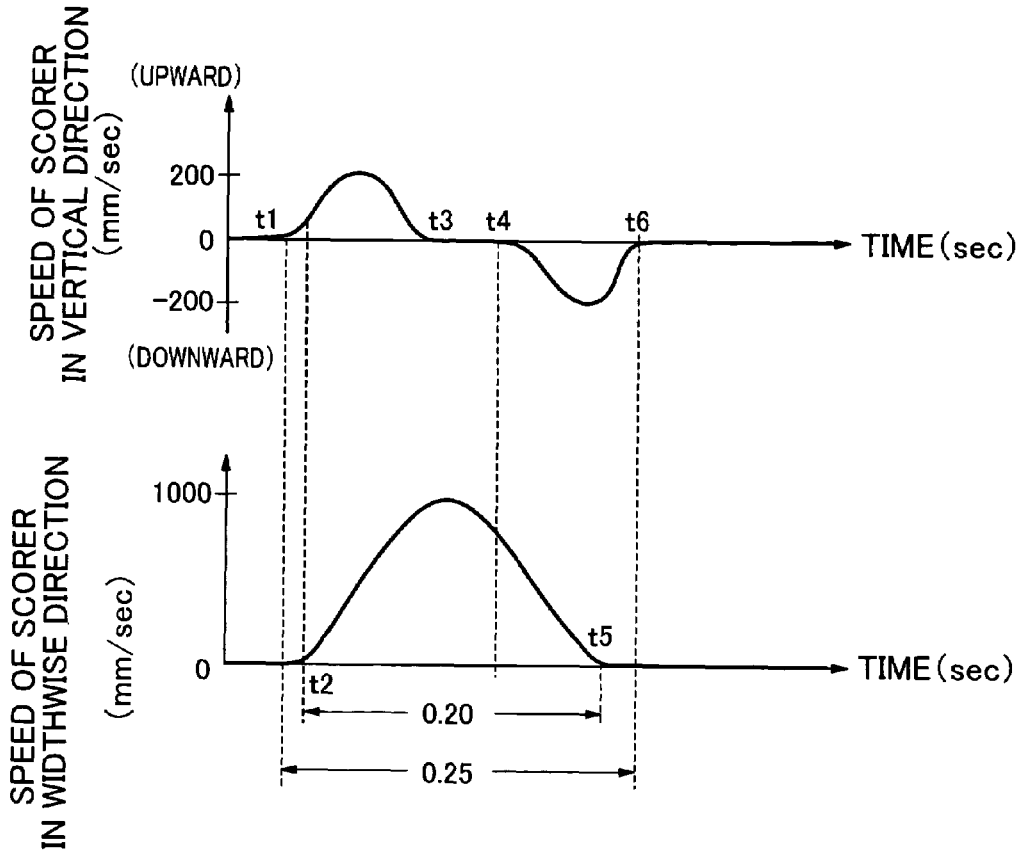
FIG. 16 is a graph showing the movement path of the scorer wherein the speed of the scorer is shown on Y axis, while time is shown on X axis.

FIG. 16 is a graph showing the moving path of the scorer wherein the speed of the scorer is shown on Y axis, while time is shown on X axis. FIG. 17 is a similar view to the FIG. 11 showing the moving path of the scorer.

Figure 17:
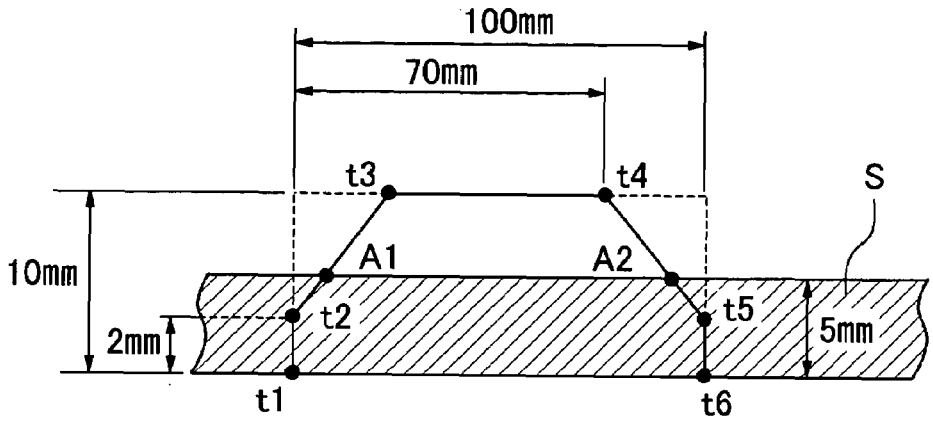
FIG. 17 is a positional diagram similar to FIG. 11, showing a movement path of the scorer of the slitter-scorer apparatus used in a bench mark test.
Figure 18:
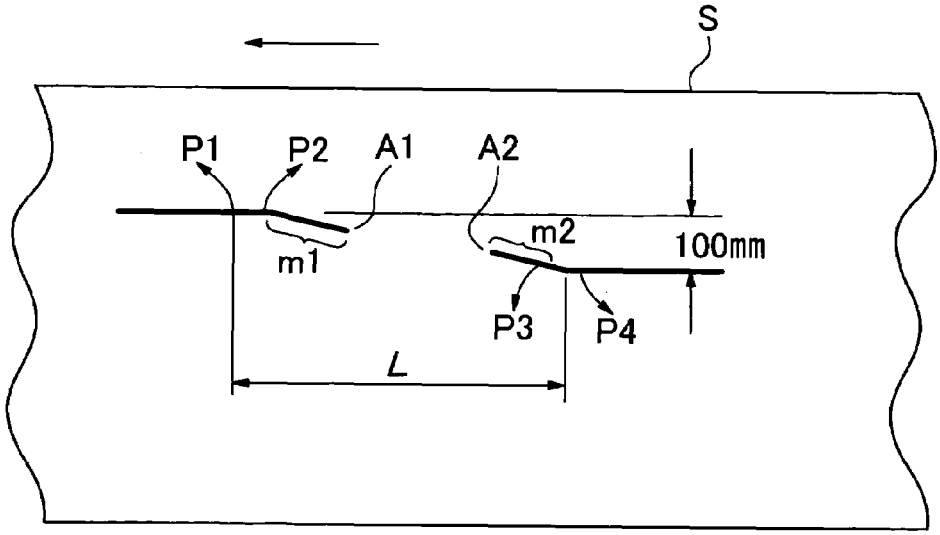
FIG. 18 is a partial plan view showing the scored mark processed upon the surface of the paperboard using a slitter-scorer apparatus used in a bench mark test.

As can be seen in FIGS. 16 and 17, the scorer starts moving upwardly at (t1), then having moved 10 mm at (t3), movement thereof will be finished. During such movement of the scorer, when the scorer has advanced upwardly by 2 mm (t2), i.e. resting 8 mm stroke thereof, it starts moving in widthwise direction until it has moved 100 mm at (t5). In addition, when scorer has advanced from its start point by 70 mm, i.e. 30 mm before its final position at (t4), it starts moving vertically downwardly, and stops at (t6) after moving 10 mm.

The resultant setup time for re-positioning the scorer when order has been changed is the time period from (t1) to (t6) which is 0.25 sec.

FIG. 18 illustrates an exemplary mark which appears on the surface of the paperboard sheet when the scorer is moved as shown in FIG. 17. As can be seen in FIG. 18, it was found that the paperboard does not meander during movement of the scorer, especially from those period of (t1) to (t2) and (t5) to (t6) where the scorer remains in the paperboard sheet.

As can be seen in FIG. 18, P1 and P2 correspond to the timings (t1) and (t2) respectively shown in FIG. 16, both of which have been scored shallower than normal. The successive period (m1) represents diagonal movement of the scorer after timing (t2), shown in FIG. 16, while period (m2) represents movement of the scorer before it reaches (t5), shown in FIG. 16. P3 and P4 are respectively correspond to the timings (t5) and (t6), both of which have been scored shallower than normal. The feed length L from P1 to P4 of about 750 mm will be wasted in a case of order change, which corresponds to the equation 3000 mm/sec×0.25 sec (t1 to t6 in FIG. 16).

According to the above described bench mark test, we confirmed that the length of the wasted paperboard sheet will be reduced, without meandering of the paperboard sheet, thereby increasing available yield percentage of the paperboard product.

Figure 19:
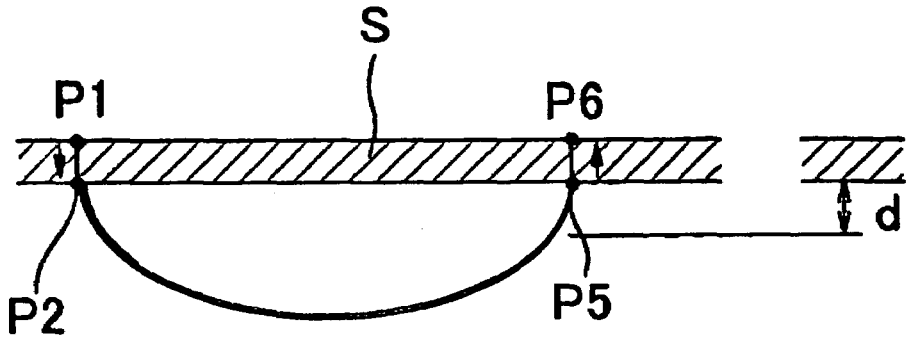
FIG. 19 is a positional diagram showing a movement path of slitter-scorer along a curved line defining a generally convex shape.

One of ordinary skill in the art would understand that this specific configuration is given as an example and not meant to limit the invention. For example, in the preferred embodiment described above, the slitter knife or blade is moved simultaneously both in vertical and widthwise directions via driving both servo motors therefor, but it might be possible to move the slitter knife or blade diagonally during either its upper movement or downward movement. Also, as shown in FIG. 19, the moving path of the slitter and/or scorer can be a curved line, e.g. parabola curve which is different from the described zigzag-like line.

According to the method for controlling a slitter-scorer apparatus of the present invention, the feed line for the paperboard sheet does not need to be stopped when order specification of cutting or scoring for the paperboard sheet has been changed, thereby reducing a setup time.

Furthermore, according to the method for controlling a slitter-scorer apparatus of the present invention, the feed line for the paperboard sheet does not need to be stopped when order specification of cutting or scoring for the paperboard sheet has been changed, and thus meandering of the paperboard sheet can be avoided, thereby increasing available yield percentage of the paperboard product.

Also, according to the method for controlling a slitter-scorer apparatus of the present invention, the operative level of the slitter and/or scorer can be adjusted precisely in accordance with the change of the condition of processing the paperboard sheet.

What is claimed is:

1. A method for controlling a slitter-scorer apparatus, comprising the steps of:

supplying a paperboard sheet along a feed line; and moving a slitter/scorer including at least one of a slitter and a scorer in at least one of a vertical direction by a mechanism for vertically moving said slitter/scorer and a widthwise direction by a mechanism for horizontally moving said slitter/scorer to an operative level where a surface of the paperboard sheet is processed thereby, wherein each of said mechanism for vertically moving said slitter/scorer and said mechanism for horizontally moving said slitter scorer includes a servo motor, and when said slitter/scorer moves from a first widthwise position of a first operative position to a second widthwise position of a second operative position, said slitter/scorer is caused to start moving only in the vertical direction while a level of said at least one of said slitter/scorer is between a bottom surface of the paperboard sheet and a top surface of the paperboard sheet, and then said slitter/scorer is moved simultaneously in the vertical direction and in a cross machine direction which said cross machine direction is oriented from said first widthwise position to said second widthwise position in part along a first diagonal path portion disposed on a first line and thereafter said slitter/scorer moves in part along a second diagonal path portion disposed on a second line that intersects the first line so that said slitter/scorer moves diagonally toward said second cross machine position before said slitter/scorer again moves only in the vertical direction and after said slitter/scorer initially moved only in the vertical direction.

2. A method as recited in claim 1, wherein said slitter/scorer is moved simultaneously in said vertical direction and in said widthwise direction so that said slitter/scorer moves diagonally toward said second widthwise position when said slitter/scorer moves from said first widthwise position of said first operative level to said second widthwise position of said second operative level.

3. A method as recited in claim 2, wherein said diagonal movement of said slitter/scorer occurs while said slitter/scorer is positioned in the paperboard sheet.

4. A method as recited in any one of claims 2 or 3, wherein a path of movement of said slitter/scorer forms a plurality of straight lines which define a generally convex shape which is oriented in such a way that the nearer said straight lines come to a peak of the generally convex shape, the more said straight lines are separated from said surface of the paperboard sheet.

5. A method as recited in any one of claims 2 or 3, wherein a path of movement of said slitter and/or scorer forms a curved line which defines a generally convex shape which is oriented in such a way that the nearer the curved line comes to its peak, the more the curved line is separated from said surface of the paperboard sheet.

6. A method as recited in claim 1, wherein said slitter has an anvil positioned relative to a slitter blade of said slitter such that the paperboard sheet will be clamped therebetween, and said operative level being adjusted in accordance with the depth of the wear of said anvil during a setup step of said operative level so that said slitter blade penetrates into said anvil.

* * * * *